United States Patent [19]

Sanbuichi et al.

[11] Patent Number: 4,870,937

[45] Date of Patent: Oct. 3, 1989

[54] AIR FUEL MIXTURE A/F CONTROL SYSTEM

[75] Inventors: Hiroshi Sanbuichi, Yokohama; Katsunori Terasaka, Yokosuka; Toyoaki Nakagawa, Yokohama, all of Japan

[73] Assignee: Nissan Motor Company, Limited, Yokohama, Japan

[21] Appl. No.: 948,073

[22] Filed: Dec. 31, 1986

[30] Foreign Application Priority Data

Jan. 13, 1986 [JP] Japan ..... 61-5839

[51] Int. Cl.[4] ..... F02D 41/18

[52] U.S. Cl. ..... 123/488; 123/494; 73/118.2

[58] Field of Search ..... 123/494, 488, 480; 73/118.2

[56] References Cited

U.S. PATENT DOCUMENTS

| | | | |
|---|---|---|---|
| 4,402,294 | 9/1983 | McHugh et al. | 123/494 |
| 4,527,530 | 7/1985 | Abe et al. | 123/494 |
| 4,562,814 | 1/1986 | Abe et al. | 123/488 |
| 4,604,703 | 8/1986 | Hasagawa | 364/431.07 |

FOREIGN PATENT DOCUMENTS

| | | | |
|---|---|---|---|
| 0130382 | 1/1985 | European Pat. Off. . | |
| 3311892 | 10/1983 | Fed. Rep. of Germany . | |
| 60-169647 | 9/1985 | Japan | 123/494 |

OTHER PUBLICATIONS

"Development of the Toyota Lean Combustion System", published in Nainen Kikan, vol. 23, Oct. 1984, pp. 33–40.

*Primary Examiner*—Andrew M. Dolinar

*Attorney, Agent, or Firm*—Foley & Lardner, Schwartz, Jeffery, Schwaab, Mack, Blumenthal & Evans

[57] ABSTRACT

The amount of air being inducted into the cylinders of an internal combustion engine is detected and a signal indicative thereof is sampled at a predetermined intervals. The difference between two sampled values is used with the time required for a single induction phase to be carried out, to predict the total amount of air which will be inducted into each cylinder. Utilizing this approximation the amount of fuel which should be injected or otherwise supplied to the engine can be accurately determined and thus enable accurate real-time cycle to cycle A/F control.

18 Claims, 3 Drawing Sheets

AIR FUEL MIXTURE A/F CONTROL SYSTEM

BACKGROUND OF THE INVENTION

1. Field of the Invention

The present invention relates generally to a fuel injection system for an internal combustion engine and more specifically to such a system which enables accurate real time control of the amount of fueld which is to be injected per cylinder by approximating, at/or prior to the beginning of each induction phase, the the total amount of air which will be charged into each cylinder of the engine during the instant induction phase.

2. Description of the Prior Art

A previously proposed injection control system for an internal combustion engine has been disclosed in an article entitled 'Development of the Toyota Lean Combustion System' published in 'NAINEN KIKAN' Vol. 23 Oct. 1984 issue pages 33 to 40. This system strives to control the air-fuel ratio of the air-fuel mixture charged into the cylinders of the engine over a wide range spanning approximately stoichiometric to lean mixtures. In order to initially determine the appropriate air-fuel mixture, the output of an induction pressure sensor is used to sense how much air is being inducted into the engine. Subsequently, to enable feed-back control of the injection volume a specially developed air-fuel ratio sensor capable of sensing air-fuel ratios until the mixtures become super lean is used.

In this system, because the amount of fuel supplied to the engine varies with the load thereon it is necessary to correct the output of the pressure sensor before using the same in the appropriate calculations.

However, even though the pressure sensor output matches the actual induction air flow reasonably accurately, the derivation of the injection amount per cylinder, although not critical under most modes of operation, becomes inadequate when leaner mixtures are involved, namely, mixtures leaner than those (eg. super lean mixtures) which can be accurately sensed by the air-fuel ratio sensor and corrected by feed-back control.

The calculation of the amount of fuel required is carried out in a microprocessor at a predetermined timing prior to actual injection. In order to provide sufficient time for the calculation, the output of the pressure sensor is read at a time prior the start of the induction phase (e.g. at a time $t_1$ - see FIG. 5).

However, as will be appreciated from FIG. 5, the amount of air continues to be introduced into the cylinder at least until time $t_3$ (the end of the induction phase) depending on the valve overlap and ramming characteristics of the induction system, while the injection of fuel terminates at a time $t_2$. As will be appreciated that the actual amount of air inducted into the cylinder and which mixes with the fuel therein is more accurately represented by the pressure sensor output which occurs at time $t_3$ (noting that PB1<PB3).

This of course means that the correction according to the reading of the pressure sensor at time $t_1$ is not really effective and thus leaves the system completely dependent on the air-fuel ratio sensor feed-back control and renders the same unable to improve the control level sufficiently rapidly to that which will be necessary in the near future in order to meet stricter emission control standards which will become mandatory at that time.

SUMMARY OF THE INVENTION

It is an object of the present invention to provide an air-fuel ratio control system for an automotive internal combustion engine or the like which obviates the above mentioned drawback by accurately approximating how much air is actually inducted and therefore how much fuel should be injected, and thus enables more accurate real-time A/F control prior to actual combustion.

In brief, the above object is achieved by an arrangement wherein the amount of air being inducted into the cylinders of an internal combustion engine is detected and a signal indicative thereof is sampled at a predetermined brief interval. The difference between two sampled values is used in combination with the time required for a single induction phase to be carried out, to predict the total amount of air which will be inducted into each cylinder. Utilizing this approximation the amount of fuel which should be injected or otherwise supplied to the engine can be accurately determined prior to actual injection thereof and avoid the lag in A/F correction which is inherent with 'after the fact' type feed-back control.

More specifically, a first aspect of the present invention comes in the form of a method of operating an internal combustion engine comprising the steps of: measuring a signal which varies with the amount of air inducted into the engine; recording first and second values of the signal at a predetermined time interval; approximating, based on the difference between the first and second values, the amount of air which will be inducted during the instant induction phase of the engine; and determining the amount of fuel to be supplied to the engine during the instant induction phase based on the approximated induction air volume.

A further aspect of the present invention comes in the form of an internal combustion engine which is characterized by means for detecting the amount of air being inducted into the engine and producing a first signal indicative thereof; means for detecting the time required for a phase of the engine to be completed and producing a second signal indicative thereof; means for: (a) approximating, based on the first and second signals, the total amount of air which will be inducted into a cylinder of the engine during the time required for a single phase of engine operation, and (b) calculating the amount of fuel which is required to be supplied into the cylinder during the instant induction phase of the engine based on the approximated amount of air; and means for supplying the calculated amount of fuel during the induction phase of the engine.

DETAILED DESCRIPTION OF THE PREFERRED EMBODIMENTS

Figure 1:
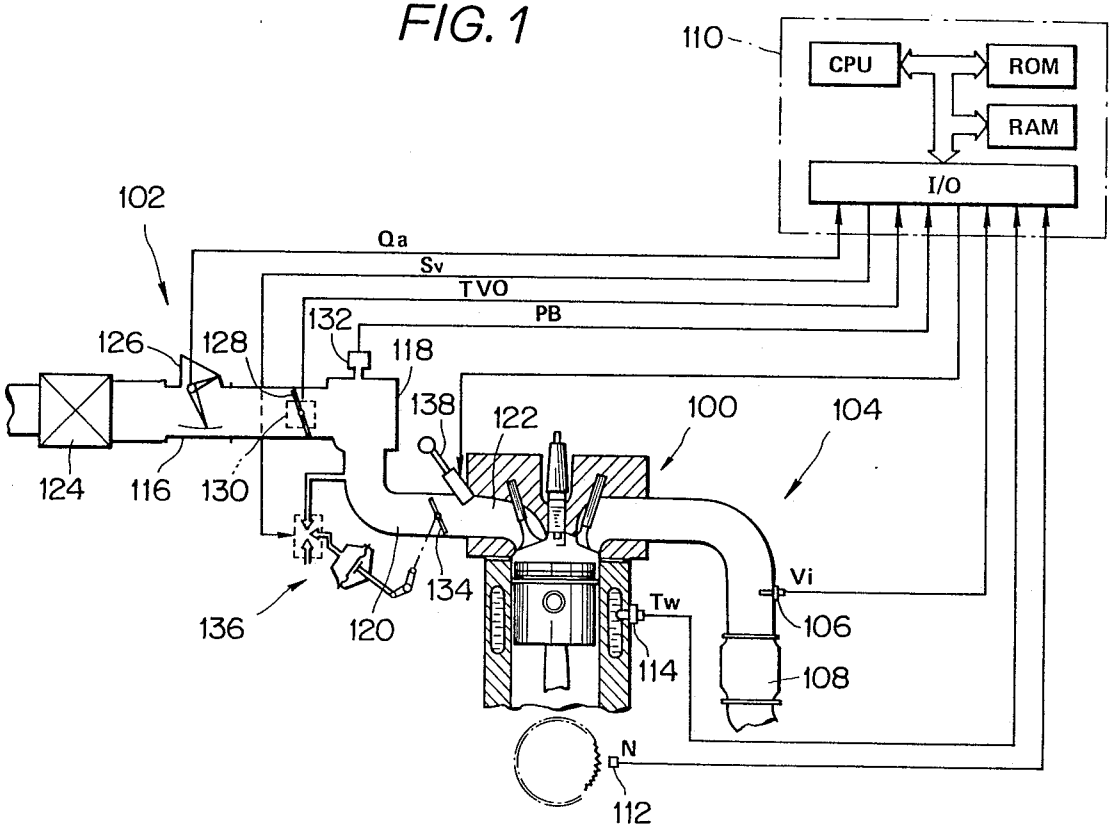
FIG. 1 shows in schematic form an engine system to which the embodiments of the present invention are applied.

FIG. 1 shows an engine system to which the embodiments of the present invention are applied. In this arrangement the numeral 100 denotes an internal combustion engine which is equipped with an induction system generally denoted by 102 and exhaust system generally denoted by 104. The exhaust system includes an air-fuel ratio sensor 106 which in this instance takes the form of an oxygen sensor of the type which exhibits a marked change in output voltage at the stoichiometric A/F value. Located downstream of the $O_2$ sensor is a 'three-way' catalytic converter 108 (viz., a unit which is capable of simultaneously reducing the emission levels of CO, HC and NOx). The output Vi of the $O_2$ sensor 106 is fed to the I/O interface of a microprocessor which forms the heart of a control circuit 110.

Although not shown, it will be appreciated that the output of the $O_2$ sensor 106 is suitably A/D converted prior to supply to the I/O interface.

The output (signal N) of a crank angle sensor 112 and that of an engine coolant temperature sensor 114 (signal Tw) are similarly supplied to the microprocessor via the I/O. In the case these sensors produce analog signals then A/D conversion is carried out in a manner similar to that performed in connection with the analog signal produced by the $O_2$ sensor.

The induction system 102 includes an induction manifold comprised of a induction passage 116, collector section 118 and branch runners 120. The branch runners lead from the collector 118 to the respective inlet ports 122 of the engine. An air cleaner 124 and a flap type air flow sensor 126 are disposed at the upstream end of the induction passage 116. The air flow meter 126 is arranged to generate a signal Qa representative of the amount of air passing therethrough. This signal is supplied to the I/O interface of the microprocessor in digitized form.

A throttle valve 128 is disposed in the induction passage upstream of the collector section 118. A throttle valve position sensor 130 is operatively connected with the throttle valve 128 and arranged to output a signal TVO indicative of the opening degree thereof. This signal is digitized and supplied to the control circuit 110 as shown.

An induction pressure sensor 132 is arranged to be responsive to the pressure prevailing in the collector section 118 and inputs a signal PB indicative thereof to the I/O interface the control unit microprocessor.

A swirl control valve 134 is disposed in each of the branch runners 120 immediately upstream of the intake ports 122 formed in the engine cylinder head and arranged to control the flow of air entering the respective combustion chambers in a manner to promote a suitable swirl therein. A swirl control valve servo mechanism 136 is operatively connected with each of the swirl valves 134 and arranged to control the positions thereof in response to a control signal Sv issued by the control unit 110. An example of a swirl generating arrangement can be found in U.S. Pat. No. 4,651,693 in the name of Nakajima et al. The content of this patent is hereby incorporated by reference thereto.

Fuel injectors 138 (one in each branch runner) are arranged to inject fuel toward the the downstream end of the respective intake ports 122. The injectors 138 are controlled by signals Si issued by the control unit 110.

Although not specifically illustrated the ignition timing of the engine is also controlled by the control unit 110. As this control is not directly related to the instant invention a detailed explanation is omitted.

The ROM of the microprocessor contains control programs which control the operation of the engine fuel injectors 138 in response to the data inputted from the various sensors of the system.

Figure 2:
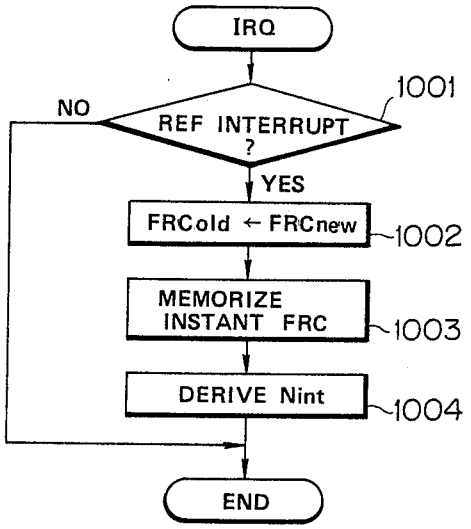
FIGS. 2 and 3 are flow charts showing the steps which characterize the operation of a first embodiment of the present invention.

FIG. 2 shows a control routine which is common to the first and second embodiments of the present invention. This routine is initiated by a hardwire interrupt signal generated by the crank angle sensor 112. In this embodiment the interrupt is induced by a Ref. signal which is generated at 180° intervals.

The first step 1001 of this program is such as to determine if a Ref. signal has just been produced or not. Until the generation of such a signal the programs returns. During this period other program are run in accordance with their predetermined schedules.

Upon the detection of a Ref. signal the program flows to step 1002 wherein a free running counter (FRC) value 'FRCold' is updated by changing it to correspond to a 'FRCnew' value recorded in the previous run and which has been temporarily stored in RAM. At step 1003 the instant value of a free running counter included in the microprocessor is read and the value set in RAM as the new value of FRCnew.

At step 1004 Nint is derived. This value is representative of the time required for one phase of the engine operation and is determined using the following equation:

$$Nint = FRCnew - FRCold \ldots \quad (1)$$

Figure 3:
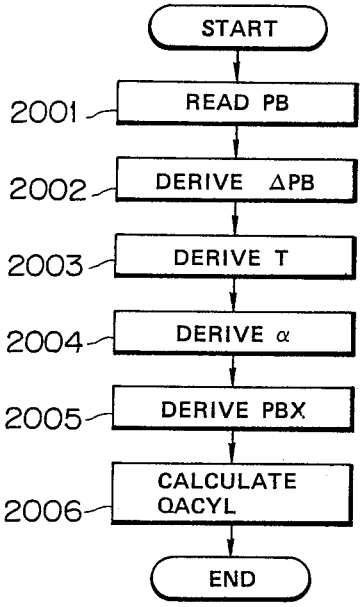

FIG. 3 is a flow chart showing the steps of a program which characterizes a first embodiment of the present invention and which executes a so called D-Jetro type air flow amount calculation. In this embodiment this program is run at 10 ms intervals. At step 2001 the output of the pressure sensor 132 is read and the instant value of signal PB determined. At step 2002 the difference between the instant PB value and that recorded during the previous run are subtracted to determine the difference therebetween. Viz.:

$$\Delta PB = PBn - PBn - 1 \ldots \quad (2)$$

wherein PBn: denotes the instant PB value; and

PBn-1: denotes the previously recorded value.

At step 2003 the value of a correction time period T is determined using the following equation:

$$T = Tc + Ti + Ttrvl + Taf \ldots \quad (3)$$

wherein:

Tc: denotes the time required to calculate the required injection volume, in this embodiment this period is 10 ms;

Tin: denotes the injection pulse width. In actual fact the value is comprised of Ti, the time required to actually inject the appropriate amount of fuel, plus Ts the voltage rise time. In this embodiment Ti=1.5–10 ms while Ts=1.5 ms;

Ttrvl: denotes the time required for the spray of injected fuel to fly through the intake port and reach the combustion chamber. In this embodiment this period is about 8 ms. However, it should be noted that this delay period varies with the flow rate of the combined air and fuel in the intake port;

Taf: denotes the period defined between the point in time wherein the fuel first beings to enter the combustion chamber to the time at which air ceases to be inducted thereinto. In the instant embodiment this period spans a crank angle of about 70°-90°. At 1200 RPM the period amounts to approximately 9.7-12.5 ms.

It can be shown that the value of Taf is approximately half of one phase time or ½Nint. Accordingly, it is possible to substitute this value in equation (3) as follows:

$$T=Tc+Ti+Ttrvl+(\tfrac{1}{2})Nnint \ldots \quad (4)$$

Figure 5:
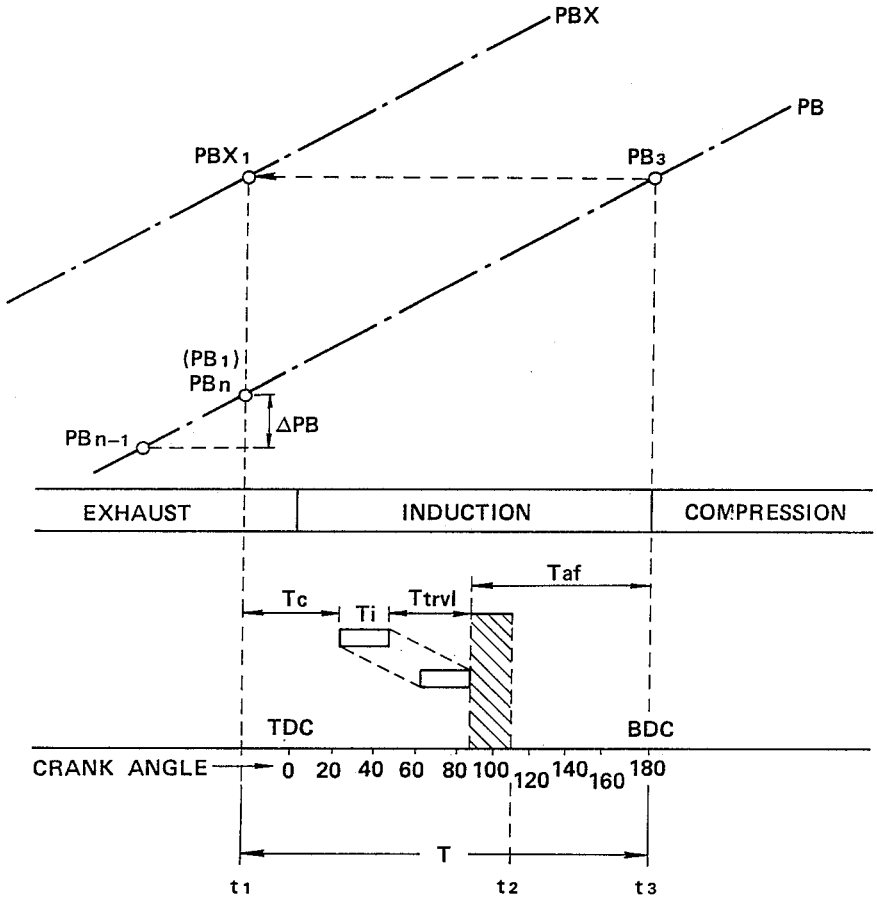
FIG. 5 is a chart showing the change in induction pressure sensor output in relation to the operational phase and crank angle of the engine.

As shown in FIG. 5, at time $t_1$ the amount of air indicated by the output of the pressure sensor 132 is PB1 and that indicated at time $t_3$ is PB3. As the trace which interconnects the points PB1 and PB3 is linear, and the time between the pressure readings is 10 ms which corresponds to the time Tc; then it is possible to derive a correction factor $\alpha$ at step 2004 as follows:

$$\alpha=T/Tc=T/10\ ms \ldots \quad (5)$$

Subsequently, at step 2005, in order to facilitate approximation of the total amount of air which will be charged into a cylinder, the present invention provides for the establishment of a trace PBX which parallels the pressure development history (trace PB) as sensed by the pressure sensor 132 and the values of which are determined using the following equation:

$$PBX=PB+\alpha\times\Delta PB \ldots \quad (6)$$

Now as will be appreciated from FIG. 5 the trace PBX is arranged so that the value thereof at time $t_1$ (viz., PBX1) is equal in value to PB3 for the instant cycle.

Thus, in step 2006 the amount of air which will be inducted into a engine cylinder can be derived (closely approximated) in the following manner:

$$QACYL=f(PBX,\ N) \ldots \quad (7)$$

wherein

N: represents the engine speed as sensed by crank angle sensor 112.

If desired it is possible to plot PBX against N and define a table map via which a table look-up can be performed or the appropriate values derived using an algorithm.

The various other possible methods of approximating the amount of air which will be inducted into the cylinder during the instant induction cycle by extrapolating consecutive pressure readings such as PBn-1 and PB1 will be evident to those skilled in the art to which the instant invention pertains. Viz., it is possible to determine the rate at which air is being inducted into each cylinder and predict on this basis the amount of air which will be inducted in total during the induction phase.

Figure 4:
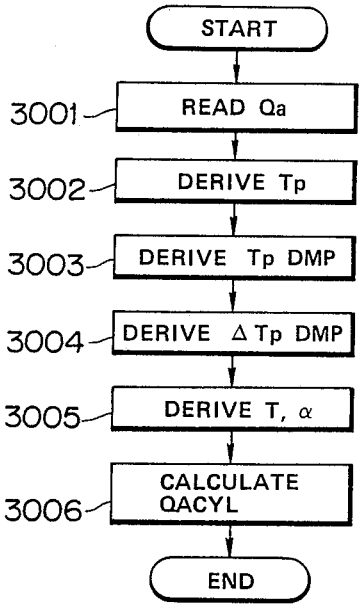
FIG. 4 is a flow chart showing the steps which characterize the operation of a second embodiment of the present invention.

FIG. 4 shows a flow chart which depicts the operations which characterize a second embodiment of the present invention.

As shown, as step 3001 the output of the air flow meter is read and the value set in RAM ready for subsequent operations. At step 3002 the value of Tp (basic fuel injection volume) is derived using the following equation:

$$Tp=K\times Qa/N \ldots \quad (8)$$

wherein K: is a constant.

At step 3003 a value TpDMP is derived:

$$TpDMP=(1-a)\times TpDMPn-1+a\times Tpn \ldots \quad (9)$$

wherein

TpDMPn: represents what shall be referred to as instant 'primary delay fuel injection volume';

TdDMPn−1: represents the previously recorded 'primary delay fuel injection volume'; and a: is a constant.

As will be understood the values TpDMPn and TpDMPn−1 are values which correspond in essence to the pressure values PBn and PBn−1 shown in FIG. 5.

Using equation (9) it is possible, according to the instant embodiment, to develop a good correlation with the value approximated by correcting the sensed induction pressure according to the first embodiment.

At step 3004 the change in the TpDMP value is determined using equation 10:

$$\Delta TpDMP=TpDMPn-TpDMPn-1 \ldots \quad (10)$$

In the first embodiment the above difference closely agrees with the ΔPB value derived using equation (2). Accordingly, at step 3005 values of T and $\alpha$ are derived using techniques essentially similar to those used in the first embodiment, and in step 3006 QACYL is calculated using the following equation:

$$QACYL=TpDMP+\alpha\times\Delta TpDMP \ldots \quad (11)$$

Thus, with the second embodiment it is also possible to accurately approximate the amount of air which is charged into the cylinder per cycle and thus enable the same desirable real-time A/F control.

What is claimed is:

1. A method of operating an internal combustion engine comprising the steps of:

measuring a signal which varies with the amount of air inducted into said engine;

recording first and second values of said signal at a predetermined time interval;

calculating a time period which begins at the time of one of said first and second samplings and which includes a factor which is approximately one half the time required for one induction cycle of said engine;

approximating, based on the difference between said first and second values and said time period, the amount of air which will be inducted during an instant induction phase of the engine; and determining the amount of fuel to be supplied to the engine during the instant induction phase based on the approximated induction air amount.

2. A method as claimed in claim 1 wherein at least one of said first and second values is recorded prior to the initiation of the induction phase of the engine.

3. A method as claimed in claim 1 wherein said signal is produced by a pressure sensor which senses the pressure prevailing in the induction system at a location upstream of the engine cylinder into which fuel is to be supplied.

4. A method as claimed in claim 1 wherein said signal is produced by an air flow sensor which is disposed at a location upstream of the cylinder into which fuel is supplied.

5. An internal combustion engine comprising:

means for detecting the amount of air being inducted into said engine and producing a first signal indicative thereof;

means for detecting the time required for a phase of the engine to be completed and producing a second signal indicative thereof;

means for sampling said first signal at first and second time points;

means for calculating a time period which includes a factor which is approximately one half of the time required for one phase of said engine to be completed means for approximating, based on the first and second samplings and said time period, the total amount of air which will be inducted into a cylinder of the engine during the time required for a single phase of engine operation;

means for calculating the amount of fuel which is required to be supplied into the cylinder during said single induction phase of the engine based on the approximated amount of air; and means for supplying the calculated amount of fuel during the single induction phase of said engine.

6. An internal combustion engine as claimed in claim 5 wherein said air induction amount detecting means comprises an induction pressure sensor disposed in an induction system at a location upstream of the engine cylinder.

7. An internal combustion engine as claimed in claim 5 wherein said air induction amount detecting means comprises an air flow meter disposed in an induction system at a location upstream of the engine cylinder.

8. An internal combustion engine as claimed in claim 5 wherein said time detecting means comprises a crank angle sensor operatively associated with a crankshaft of the engine.

9. An internal combustion engine as claimed in claim 5 wherein said time period begins at one of said first and second time periods.

10. An internal combustion engine as claimed in claim 9 wherein said time period finishes at the end of the induction phase.

11. An internal combustion engine as claimed in claim 5 wherein said time period begins at the second time period.

12. A method of operating an internal combustion engine comprising the steps of:

producing a signal which varies with the amount of air flowing through an induction system of said engine;

recording first and second values of said signal at predetermined time intervals;

determining the time for one induction phase of the engine;

approximating, based on a difference in values between said first and second signals and a time period which is a predetermined fraction of the determined time required for one induction phase, the amount of air which will be inducted into a predetermined cylinder of said engine during an instant induction phase of said predetermined cylinder; and determining the amount of fuel to be supplied into said predetermined cylinder during the instant induction phase based on the approximated induction air amount.

13. An internal combustion engine comprising:

a sensor for detecting the amount of air being inducted through an induction system of the engine and producing a first signal indicative thereof;

means for detecting the time required for a single induction phase of said engine and producing a second signal indicative thereof;

means for approximating, based on the first and second signals and a period which is a predetermined fraction of the time required for one induction phase of the engine, the total amount of air which will be inducted into a predetermined cylinder of the engine during said single induction phase;

means for calculating the amount of fuel which is required to be supplied into said predetermined cylinder during an instant induction phase of the engine based on the approximated total amount of air; and means for supplying the calculated amount of fuel into said predetermined cylinder during the instant induction phase of the engine.

14. A method of operating an internal combustion engine comprising the steps of:

determining the time required for one induction phase of the engine;

measuring the pressure prevailing in the induction system of the engine and producing a signal indicative thereof;

sampling the pressure signal at a first time, said first time being selected to be one of (a) before the beginning of the induction phase of a cylinder and (b) during the initial stage of the induction phase of said cylinder;

sampling the pressure at a second time which occurs a predetermined first time period after the first time; and approximating, based on the difference between said first and second samplings and a second time period which varies in accordance with the time required to perform one induction phase and which includes a factor which is approximately one half of the time required for one induction phase of said engine, the amount of air which will be inducted into said cylinder of said engine during an instant induction phase.

15. A method as recited in claim 14 further including the step of supplying an amount of fuel to said cylinder duirng said instant induction phase based on said approximated amount of air.

16. An internal combustion engine comprising:

means for determining the time required for one induction phase of the engine to be completed;

a pressure sensor which measures the pressure prevailing in the induction system of the engine and produces a pressure signal indicative thereof; and means responsive to said time determining means and said pressure sensor for:

(i) sampling the pressure signal at a first time, said first time being selected to be one of (a) before the beginning of the induction phase of a cylinder and (b) during the initial stage of the induction phase of said cylinder;

(ii) sampling the pressure signal at a second time which occurs a predetermined first time period after the first time; and (iii) approximating, based on the difference between said first and second samplings and a second period which varies with the time required to perform one induction phase, the amount of air which will be inducted into said cylinder of said engine during an instant induction phase.

17. In a method of controlling the fuel injection of an internal combustion engine having a cylinder and a fuel injector, the steps comprising:

producing a signal which varies with an amount of air inducted into said engine;

sampling a magnitude of said signal at a first time;

sampling said signal at a second time which occurs a predetermined period after the first sampling;

determining a period difference between said first and second samplings;

determining a time required for one induction cycle of said engine;

calculating a product as used as a correction factor which is derived using a correction time period divided by the period of difference defined between said first and second samplings, said correction time comprising:

a first period of time required to calculate an amount of fuel which should be injected;

a second period required for a fuel injector to inject the calculated amount of fuel;

a third period of time which is approximately one half of the time required for one induction cycle of said engine; and determining a value which is indicative of the amount of air which will be inducted into a cylinder of the engine during an instant cycle using:

the magnitude of said second sampling, the product of said correction factor and the difference between said first and second samplings.

18. In a method of controlling the fuel injection of an internal combustion engine having a cylinder and a fuel injector, the steps comprising:

producing a signal which varies with an amount of air inducted into said engine;

sampling a magnitude of said signal at a first time, said first time occurring during an exhaust phase of said engine;

sampling said signal at a second time which occurs a predetermined period after the first sampling, said second time occurring during one of (a) the same exhaust phase in which said first sampling is taken and (b) an initial stage of an induction phase which immediately follows said exhaust phase;

determining a period of difference between said first and second samplings;

determining a time required for one induction cycle of said engine;

calculating a product used as a correction time which is derived using a correction time period divided by the period of difference defined between said first and second samplings, said correction time comprising:

a first period of time required to calculate an amount of fuel which should be injected;

a second period of time required for a fuel injector to inject the calculated amount of fuel;

a third period of time required for the injected amount of fuel to enter the cylinder; and a fourth period of time which is approximately one half of time required for one cycle of said engine; and determining a value which is indicative of the amount of air which will be inducted into a cylinder of the engine during an instant cycle using:

magnitude of said second sampling plus the product of said correction factor and the period of difference between said first and second samplings.

* * * * *